US005636523A

United States Patent [19]

Assaf

[11] Patent Number: 5,636,523

[45] Date of Patent: Jun. 10, 1997

[54] LIQUID RING COMPRESSOR/TURBINE AND AIR CONDITIONING SYSTEMS UTILIZING SAME

[75] Inventor: Gad Assaf, Rehovut, Israel

[73] Assignee: Energy Converters Ltd., Ofakim, Israel

[21] Appl. No.: 373,949

[22] Filed: Jan. 17, 1995

Related U.S. Application Data

[63] Continuation-in-part of Ser. No. 153,034, Nov. 17, 1993, abandoned.

[30] Foreign Application Priority Data

Nov. 20, 1992 [IL] Israel ..... 103824

[51] Int. Cl.[6] ..... F25D 9/00; F04C 19/00

[52] U.S. Cl. ..... 62/402; 62/87; 417/68

[58] Field of Search ..... 417/68, 69; 62/87, 62/402

[56] References Cited

U.S. PATENT DOCUMENTS

| | | | |
|---|---|---|---|
| 1,668,532 | 5/1928 | Stewart | 417/68 |
| 2,364,370 | 12/1944 | Jennings | 417/68 |
| 2,937,499 | 5/1960 | Kempt | 417/68 |
| 3,241,741 | 3/1966 | Brever | 417/68 |
| 3,967,466 | 7/1976 | Edwards | 62/91 |
| 4,359,313 | 11/1982 | Bernard | 417/68 |
| 4,580,720 | 4/1986 | Strop et al. | 237/65 |
| 4,679,987 | 7/1987 | Olsen | 417/68 |
| 4,718,834 | 1/1988 | Ebner | 417/68 |
| 4,984,432 | 1/1991 | Corey | 62/402 X |
| 5,038,583 | 8/1991 | Gali | 62/402 X |
| 5,251,593 | 10/1993 | Pedersen | 417/68 X |

FOREIGN PATENT DOCUMENTS

| | | | |
|---|---|---|---|
| 0246782 | 11/1987 | European Pat. Off. . | |
| 495979 | 3/1930 | Germany . | |
| 908658 | 4/1954 | Germany | 417/68 |
| 2605423 | 8/1977 | Germany . | |
| 4036516 | 5/1991 | Germany | 417/68 |
| 240663 | 1/1946 | Switzerland | 417/68 |
| 121519 | 12/1918 | United Kingdom . | |
| 8606156 | 10/1986 | WIPO . | |
| 9015250 | 12/1990 | WIPO . | |

*Primary Examiner*—William E. Wayner

*Attorney, Agent, or Firm*—Roylance, Abrams, Berdo & Goodman

[57] ABSTRACT

A rotating liquid ring compressor/turbine (RLRC/T), including a rotor having a core and a plurality of radially extending vanes mounted thereon, a tubular jacket having outer and inner lateral portions, eccentrically, rotationally coupled with the rotor. The jacket defines with the rotor a first zone, wherein edges of the vanes rotate in proximity to a first inner surface portion of the jacket and a second zone, wherein edges of the vanes rotate in spaced-apart relationship along a second inner surface portion of the jacket. There is also provided an inlet port communicating with the second zone and an outlet port communicating with the first zone. The eccentricity ecr of the jacket mounted on the rotor is given by: ecr≈(1−c)/3, where c is the ratio between the radius of the core C and the radius R of the jacket c=C/R.

24 Claims, 5 Drawing Sheets

LIQUID RING COMPRESSOR/TURBINE AND AIR CONDITIONING SYSTEMS UTILIZING SAME

This application is a continuation-in-part of U.S. patent application Ser. No. 08/153,034, entitled Liquid Ring Compressor/Turbine and Air Conditioning Systems Utilizing Same and filed on Nov. 17, 1993, now abandoned, in the name of Gad Assaf, the subject matter of which is incorporated by reference.

The present invention relates to Liquid Ring Compressors (LRC) and to Liquid Ring Turbines (LRT) and more particularly to Rotating Liquid Ring Compressors (RLRC) and Turbines (RLRT), as well as to air conditioning systems utilizing RLRC and rotating or non-rotating liquid or gas turbines.

Liquid Ring Compressors (LRC) are known and commonly used in industry, In most applications the liquid is water and in some applications it is oil. It is a simple engine with a relatively low rotating rate. For example, a 10 bar pressure gage can be obtained with less than 2000 rpm, while in conventional compressors about 20000 rpm are usually required for obtaining the same pressure. The liquid which is rejected from the compressor can be introduced into a direct or non-direct heat exchanger to be cooled and return to the LRC. This provides for efficient cooling and close to isothermal compression, which increases the efficiency of the compressor. Yet friction between the liquid ring and the stationary cylindrical wall of the compressor's housing reduces the efficiency to a level which is well below the efficiency of adiabatic compressors. The level of friction is related to the cubic power of the liquid velocity relative to the stationary cylindrical wall.

In order to reduce the friction between the ring and the stationary cylinder, there has been proposed in the U.S. Pat. No. 1,668,532 (A. C. STEWART), to provide a rotary machine, which is substantially free from sliding friction and in which the friction between the metallic surfaces is reduced to a minimum. It appears, however, that such machines were not realized in industry, since in order to be useful, many other important structural features have to be considered, as will be described hereinafter.

It is therefore a broad object of the present invention to overcome the drawbacks of the known RLRC and of the RLRT and to provide more efficient RLRC and RLRT.

It is a further object of the invention to provide heat pumps for air conditioning and space heating systems utilizing more efficient RLRC, RLRT or both.

In accordance with the present invention there is therefore provided a rotating liquid ring compressor/turbine (RLRC/T), comprising a rotor having a core and a plurality of radially extending vanes mounted thereon, a tubular jacket having outer and inner lateral portions, eccentrically, rotationally coupled with said rotor, said jacket defining with said rotor a first zone, wherein edges of said vanes rotate in proximity to a first inner surface portion of said jacket and a second zone, wherein edges of said vanes rotate in spaced-apart relationship along a second inner surface portion of said jacket, an inlet port communicating with said second zone, and an outlet port communicating with said first zone, wherein the eccentricity ecr of the jacket mounted on said rotor is given by:

$$ecr=(1-c)/3$$

where c is the ratio between the radius of the core C and the radius R of the jacket c=C/R The invention further provides an air conditioning system, utilizing the RLRC/T according to the present invention, comprising an air conditioning system, comprising a turbine in fluid communication with said RLRC, an engine driving said RLRC and said turbine, and a first heat exchanger in fluid communication with said RLRC, and a second heat exchanger in fluid communication with said turbine.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

While the invention will be described in the following with respect to a RLRC, it should be understood that the invention applies just as well to a RLRT, having a substantially identical or very similar construction.

Figure 1:
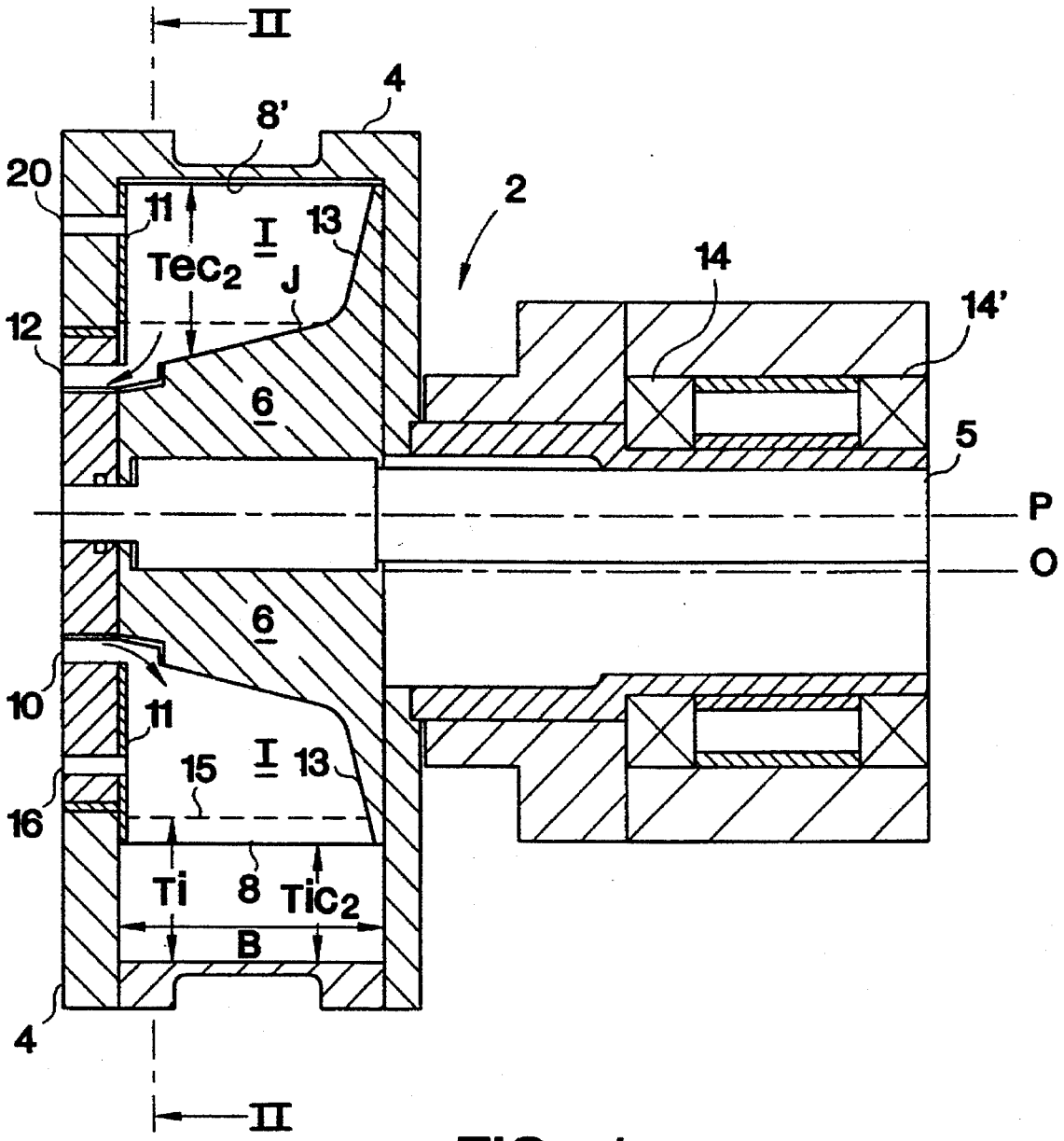
FIG. 1 is a cross-sectional view of a RLRC according to the present invention.
Figure 2:
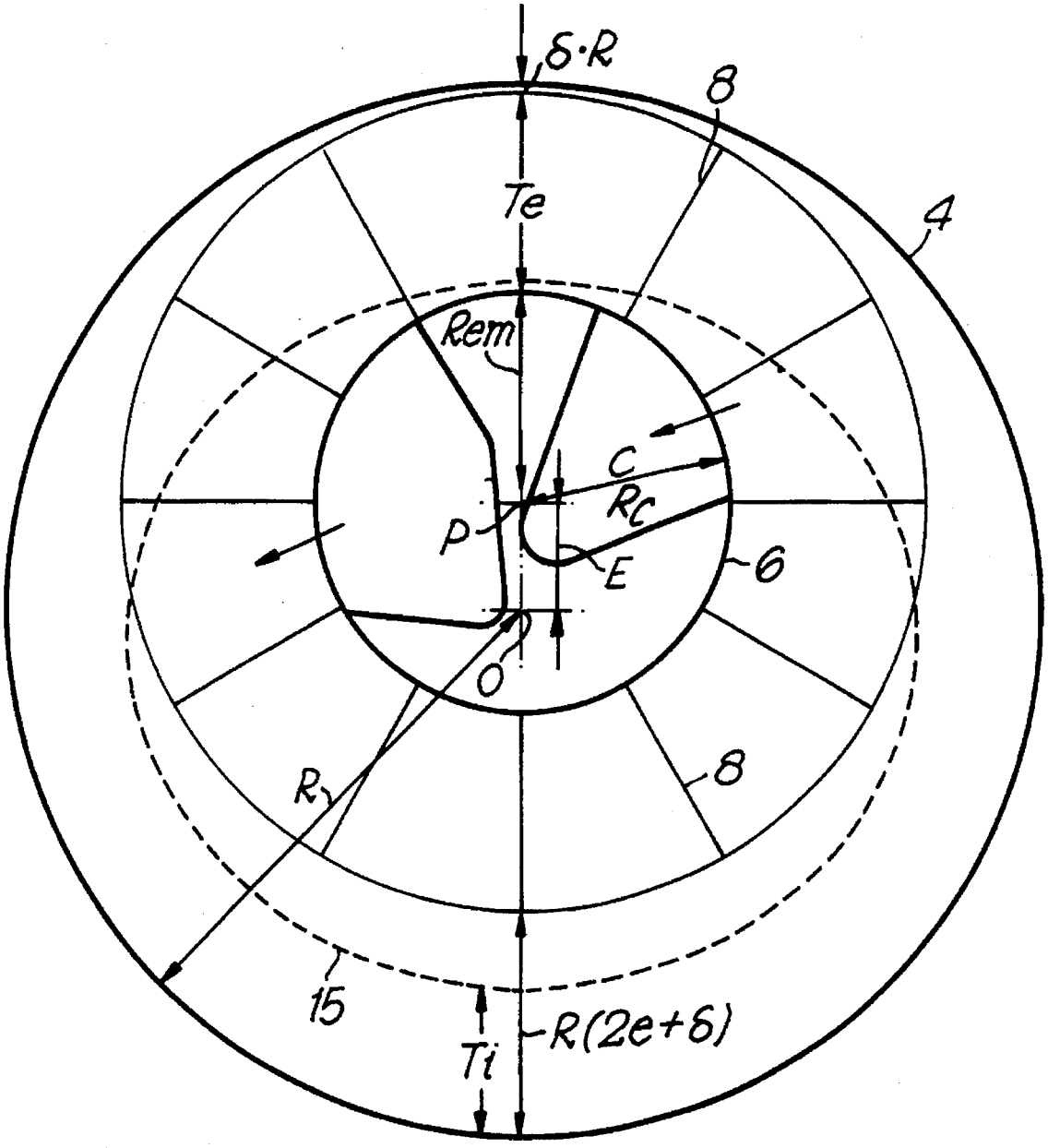
FIG. 2 is a cross-sectional view across line II—II of FIG. 1.

In FIGS. 1 and 2 there is illustrated a Rotating Liquid Ring Compressor (RLRC) 2, according to the present invention, in which, apart from the outer tubular jacket 4, the RLRC 2 comprises, per-se, known parts, including a rotor having advantageously a hollow shaft 5 and radially extending vanes 8. As seen, the rotor is eccentrically disposed with respect to the axis O of the tubular jacket 4 and which is driven by an external driving means (not shown), such as an engine. There is also provided an ambient air inlet port 10 and a compressed air outlet port 12. Through the hollow shaft 5 there may, optionally, be circulated cooling fluids. For proper sealing, there are provided sealing discs 11 and 13 at the lateral sides of the rotor vanes 8. Disc 13 may be made integrally with the core 6, as shown.

The jacket 4 is mounted, so as to allow its free rotation about the axis O. Any means for mounting the jacket 4 in a manner allowing the free rotation thereof, such as rollers, sleeves and the like, could be utilized. Preferably, as shown, the jacket 4 is mounted to two bearings 14 and 14' on one side only.

While liquid ring pumps are usually used as gas compressors and vacuum pumps, and the application for liquid pumps are rather limited, the circulation rate of liquid inside the pumps is large. Typically, the volume circulation rate of liquid is the same as the volume flow of gas, yet the density of liquid is 1000 times larger. In conventional liquid ring pumps, the liquid dissipation is large as compared with the useful work of the compressor. To maintain the liquid circulation, the rotor provides energy to the liquid.

There are three factors which determine the nature of the liquid ring:

a) The eccentricity e, which is defined as the distance E between the jacket's axis O and the rotor's axis P, divided by the jacket's radius R, e=E/R. In such cases where the jacket is not a cylinder, R is defined as the largest distance of the rotating jacket from the jacket's axis O;

b) The ratio c of the rotor's minimum core radius C to the jacket's radius R, c=C/R, and c) The volume S occupied by the solid structure of the core, vanes and discs. The total volume I of the rotor inside the jacket. The free volume F of the rotor is given by the ratio f=F/I.

The ends 8' of the rotor vanes 8 are usually close to the jacket 4 in one side of the compressor, where the distance between the rotor wings and the jacket is δ*R, and usually is small, for example, 1 mm. At the opposite side of the compressor the maximum distance between the rotor and the jacket is R(2e+δ).

In operation, the maximum depth $T_e$ of the liquid ring in the narrow eccentric zone is R*((1−e)−c), where R*(1−e−δ) is the rotor's radius, R*c, the radius of the rotor's core, and R*δ, the distance between the rotor end and the jacket at the narrow zone.

For proper operation, the bulk of the liquid ring in the wide zone R(2e+δ) will be outside the rotor. Yet, in order to provide an effective seal, a small portion of the liquid should be between the vane's edges and not as shown by the hatched line 15 in FIG. 2.

The volume q1 of the liquid circulation is practically constant over the entire ring and is determined by the flow rate in the narrow zone where practically all the liquid rotates inside the rotor.

It can be shown that inside the rotor the volume q1 is given by:

$$q1=B*f*w*R^2*((1-e)^2-rm)/2$$

where:

B is the width of the compressor inside the jacket (FIG. 1);

W is the angular velocity of the rotor in radian/s;

R*rm is the liquid minimum interface radius in the narrow zone, i.e., at the exit side of the compressor, usually Rrm≈Rc, (Rc being the rotor's core radius).

The volume Vc of the compressor inside the jacket is given by the expression:

$$Vc=B*(\pi)*R^2$$

Near the jacket, the entire pressure which includes the static pressure on the jacket and the dynamic pressure due to average velocity Vs in a given section near the jacket, is approximately constant=K:

$$K=d*Vs^2/2+p$$

where d is the liquid density and p the gas pressure.

The pressure near the jacket is about equal to the pressure near the air-liquid interface plus the pressure build-up due to the centrifugal acceleration across the liquid layer.

Comparing the pressure Pi near the jacket at the gas inlet port 10, and the pressure Pe at the outlet port 12:

$$Pi=pi+d*\int(U1*dr/r)+d*w^2*R^2*((1-e)^2-r^2)$$

$$Pe=pe+d*w^2*R^2*(r^2-r^2_m)/2+d(V_b+V_n)^2/8$$

where

Pi is the fluid pressure at the inlet;

Pe is the fluid pressure at the outlet;

U1 is the liquid velocity at the inlet;

r is the non-dimension radius of the liquid ring in respect to the center of the rotor. (R*r, the actual radius);

$V_b$ is the velocity of the vanes;

$V_n$ is the velocity of the jacket, and

∫ stands for the radial integral operation between the rotor ends and the jacket.

It can thus be shown that the pressure on the jacket which includes the static, as well as the dynamic pressure near the jacket, is approximately constant throughout the region near the internal surface of the jacket.

From the above, it appears that for the same structural geometry and outlet pressure of the liquid ring of a rotating jacket, the inlet pressure thereof will exceed the inlet pressure of a non-rotating jacket compressor.

For a proper operation the depth Ti of the liquid ring outside the rotor in the inlet wide section of the compressor (FIG. 1) should be:

$$Ti\geqq R*(2*e+\delta) \qquad \text{I}$$

so that the liquid will enter the spaces between the vanes and thereby function as the main sealing element of the compressor. Should that not be the case, e.g., as shown by the hatched line 15 in FIG. 2, part of the rotor does not participate in the compression action.

This depth should be small as compared to the effective liquid depth in the narrow zone, which is:

$$Te=R*(1-e-c)*f \qquad \text{II}$$

Since the edges of the vanes are very close to the jacket in the narrow zone, the parameter δ or R*δ can be neglected. Hence, the critical depth of the liquid ring outside the rotor becomes:

$$Ticr=2*R*e \qquad \text{III}$$

The critical liquid depth in the narrow zone is:

$$Tecr=R*(1-e-c) \qquad \text{IV}$$

From equations III and IV, the critical eccentricity ecr for rotating compressors may be given by equating Tecr with Ticr:

$$ecr=(1-c)/3$$

Typical numerical values are given by the following table:

| c | ecr |
|---|---|
| 0.3 | 0.233 |
| 0.4 | 0.200 |
| 0.5 | 0.167 |

When the eccentricity e exceeds the ecr, the liquid ring will escape from the end of the rotor vanes. In that case, the sealing of the liquid ring is not effective in the wide section of the rotating compressors.

The compression in that case is limited to a narrow section where the pressure gradient between the vanes is large. This increases the leakage loss and the hydrodynamic disturbances.

The eccentricity of RLRC requires sealing of the openings in the rotating jacket. The diameter Ds of the openings of the rotating jacket makes the sealing element expensive and energy dissipating.

Therefore, in the preferred embodiment of the present invention, the lateral sides of the rotor are sealed by discs 11 and 13, which rotate with the rotor 6 and with the jacket 4. The liquid ring also rotates between the rotor disc and the side of the rotating jacket. As the jacket rotates at a speed which is about the same speed for the rotating rotor, the centrifugal acceleration of the liquid ring in the boundary zone between the rotor and the rotating jacket is about the same as the acceleration in the main body of the liquid ring.

When the condition Ti/Te<1, the liquid ring enters the volume between the vanes of the rotor and an effective sealing is obtained, avoiding the necessity for a large and mechanical seal.

It could be assumed that under centrifugal acceleration of about 500 g, the liquid/air interface will be without waves. As it turns out, however, the interface is wavy near the air exit. In isothermal rotating compressors, liquid is introduced into the compressor for heat exchange reasoning. Some of the liquid may be evaporated, but in most cases, the bulk thereof is discharged as liquid at about the same rate as the liquid is introduced into the compressor. When the interface is smooth, the liquid ring meets the cutlet wall and forces the gas discharge out together with the liquid. In that case, there is no compressed gas return from the outlet to the entrance.

Where the interface is wavy, the wave crest meets the outlet wall at the narrow zone of the compressor and the compressed gas between the crest is circulated to the inlet port. This reduces the efficiency of the compressor as the energy introduced into the compress gas is dissipated. Thus, in order to increase the efficiency it is required to reduce the effects of waves near the exits.

Figure 3:
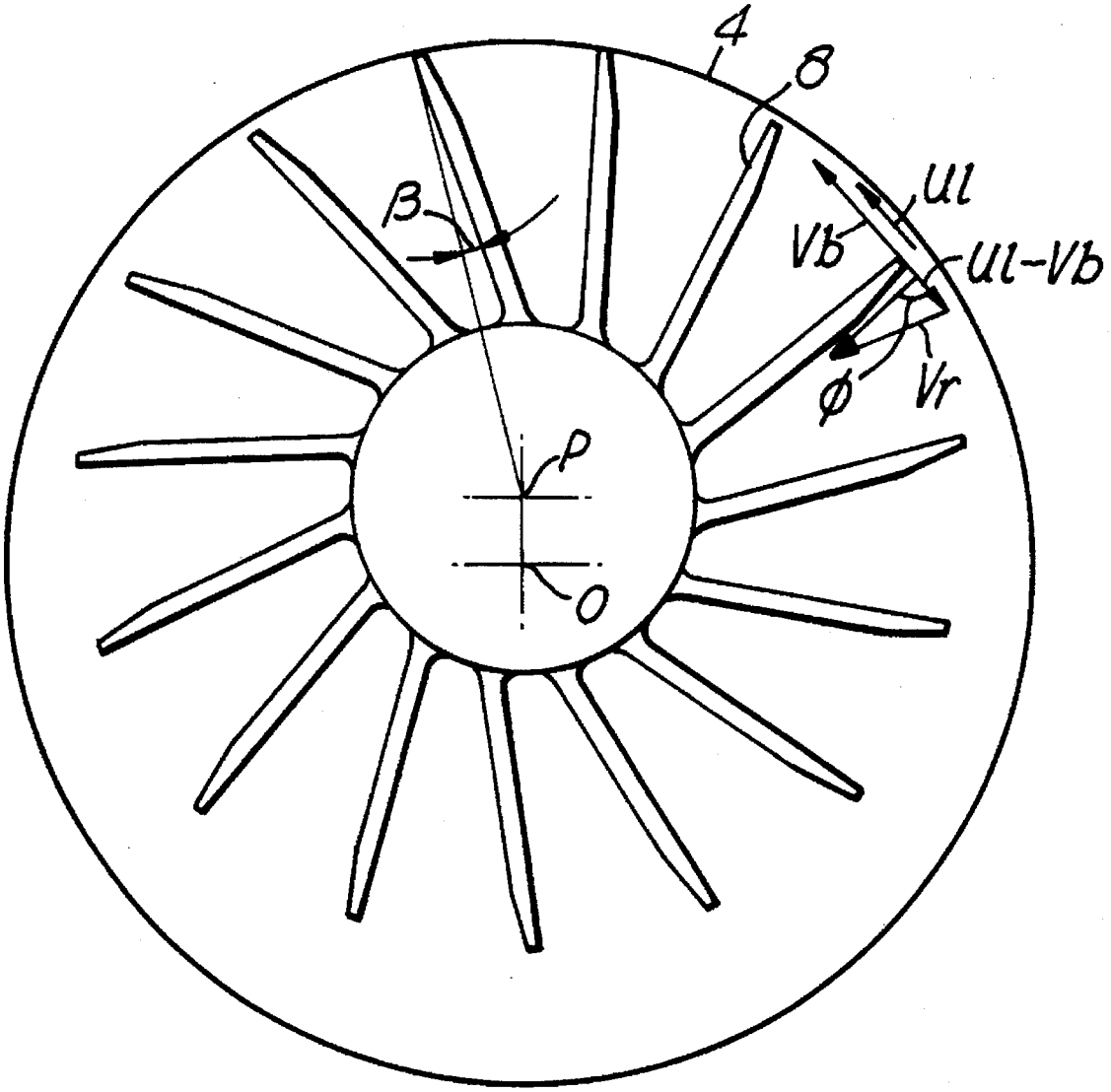
FIG. 3 is a cross-sectional view of a preferred embodiment of the rotor according to the present invention.

This is achieved by two different means: The liquid discharge rate is increased so to that the liquid discharge will carry with it more gas. It was found that the liquid mass flow rate in a rotating compressor should exceed the mass flow rate of the gas. The other means are related to the geometry near the outlet, as illustrated in FIG. 3. As shown in the Figure, there should be a relatively large number of vanes 8 and the outlet 12 (FIG. 1) should be located as close to the center of the rotor as possible. To further reduce the effects of instability, the portion J of the rotor core 6 should slope towards the outlet 12. In this way, the liquid will touch the core further away from the outlet 12 and the air volume which returns to the outlet, will be minimized.

The friction of the liquid with the jacket 4 dominates the friction of LRC. To reduce the friction, it is important that the rotor's tangential velocity, which determines the liquid velocity will be minimal. In the cutlet zone, kinetic energy is converted to pressure and the tangential liquid velocity becomes smaller as compared with pressure at the end of the rotor vanes.

In the outlet zone, the liquid radial velocity is towards the center. The tangential liquid velocity increases near the entrance of the air port, where radial velocity is away from the center.

The friction between the rotor and the liquid is related to the "Attack Angle" of the liquid at the rotor's radius. To reduce friction, the rotor vanes 8 should be directed inwardly towards the liquid vector velocity, so that the liquid velocity will be tangential to the end of the vanes. As illustrated in FIG. 3, in order to minimize friction, the angle ($\phi$) between the ends of the rotor's vanes and the rotor's radius should be so that:

$$\tan(\phi)=Vr/(Vb-U1)$$

where

Vr is the radial liquid velocity;

U1 is the tangential liquid velocity, and

Vb is the rotor's end (tangential) velocity.

Vr is related to the compressor's parameters (R, e, c and w) rate, as:

$$Vr=R*(1-e-c)*w/\pi$$

In RLRC the average liquid velocity Vr becomes comparable to the rotor's vanes velocity and the ratio Vr/(Vb–U1) is also small. Therefore, to minimize friction, the vane angles $\beta$ should also be small, e.g., <20°.

It can be shown that the pressure difference Dp=pe–pi induced by the compressor is smaller than the centrifugal pressure Cp, which characterizes the Compressor.

In many applications, it is required that the pressure difference should be large. In LRC, friction increases with the cubic power of the tangential velocity. Therefore, in most applications the vanes' velocity Vb=w*R*(1–e–$\delta$) is limited to be smaller than 20 m/s. This limits the centrifugal pressure Cp and therefore the pressure difference Dp, which is usually below 1.5 bar.

In RLRC, the velocity and therefore CP and Dp can be increased and in one step it is possible to have larger pressure difference.

As a result, doubling the rotating rate, increases the limit on the pressure difference four fold.

Increasing the rotation also increases Vr and does not affect the difference Vb–U1. As a result, the ratio (Ub–U1)/Vr becomes even smaller and the tilting of the blade ends from the radial direction should be even smaller.

In operation, the free rotation of the jacket about the axis 7 of the rotor, reduces friction of the liquid ring built up between the edges of the vanes and the inner surface of the jacket 4, thereby increasing the efficiency of the compressor/turbine.

Figure 4:
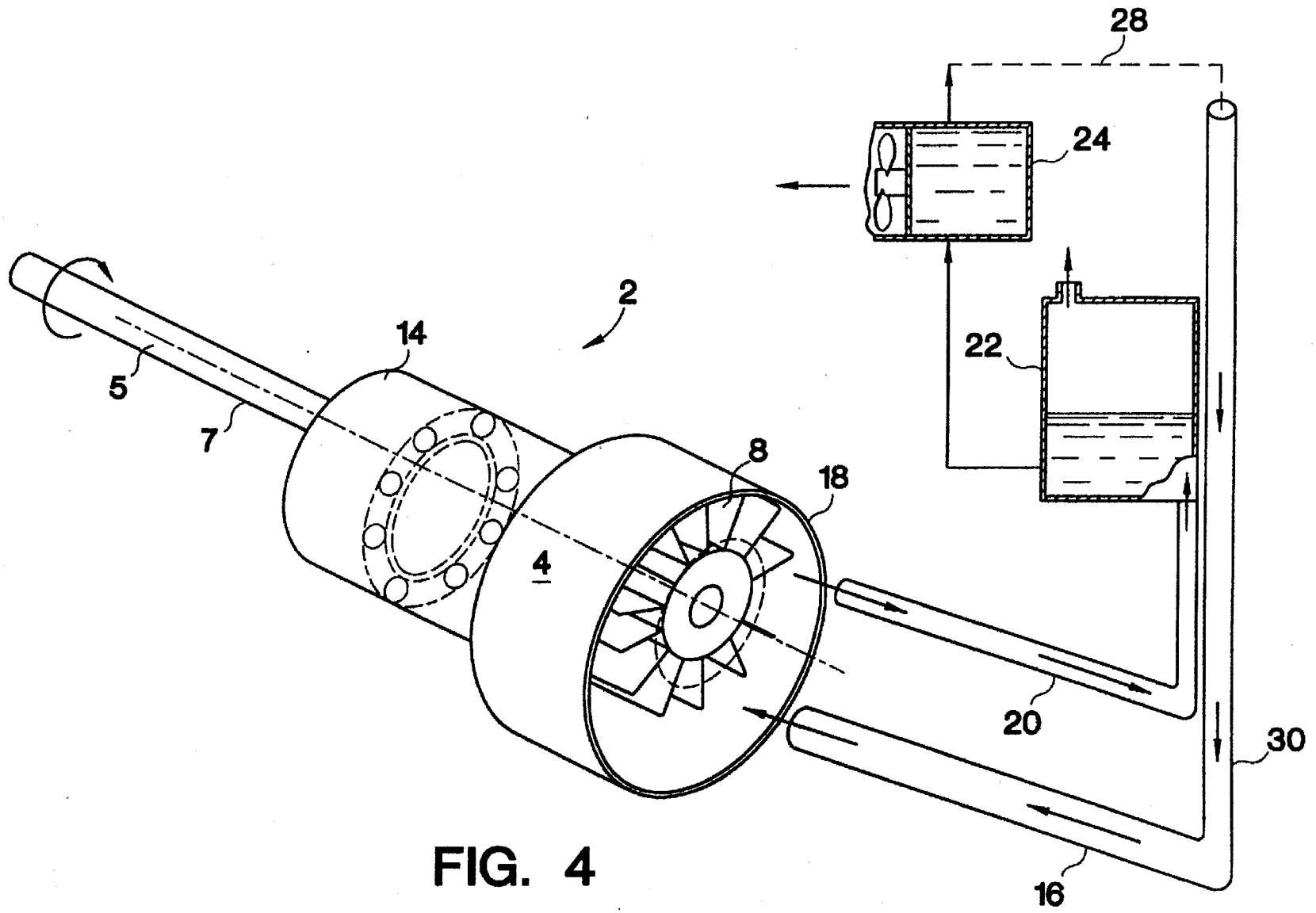
FIG. 4 is an exploded schematic isometric view of a RLRC according to the present invention, including a cooling arrangement facilitating a mode of cooling.

FIG. 4 illustrates a system for cooling the liquid in the RLRC 2, which, during operation, becomes heated. The cooling of liquid is desired in order to maintain the liquid at a low temperature, so that the gas contacting the liquid will be maintained at as low a temperature as possible, thereby requiring less energy for the compression of the gas resulting in an increase of efficiency thereof.

As seen, an efficient manner of cooling is to circulate the liquid via inlet duct 16 through the rotor chambers 18 in between the vanes 8. This increases the heat exchange action between the liquid and the gas. The liquid is then discharged through the outlet duct 20 into a gas-liquid separator 22. The separated liquid is then cooled in a direct or non-direct heat exchanger 24. The cooled liquid is then introduced via passage 28 into the duct 30, through which gas, e.g., ambient air, is also introduced into the RLRC 2.

The following is an example comparing the efficiencies of the known type of a Liquid Ring Compressor (RLC) with the RLRC of the present invention.

There is provided a LRC with a cylindrical envelope having a diameter of D=0.29 m. and a length of L=0.35 m. The eccentric shaft rotates at 1450 rpm. The tangential velocity of the liquid ring is estimated as $u=\pi(1450/60)D=21$ m/s.

The dissipation in the shear zone is estimated as $$T=(Cd)\ u^3A,$$

where

Cd is the drag coefficient, $\zeta$ is the liquid density, u is the tangential velocity and A is the surface area of the envelope.

For Cd=0.002, $\zeta=1000$ Kg/m$^3$., $A=\pi DL=0.31$ M$^2$, there is obtained T=5.74 Kw.

In this specific example the compressor consumes 15.5 Kw and it is assumed that the engine efficiency is 0.85. The power delivered to the compressor's axis is $P=0.85\times15.5=13.2$ Kw.

The thermodynamic work of the compressor is given by the expression:

$$ME_c=mRTln(p2/p1)$$

where, m is the mass flow rate,

R is the gas constant,

T is the average temperature, p2 is the pressure of compressed air, and p1 is the inlet pressure.

For $m=.11$ Kg/s, $R=.286$ Kj/Kg (air constant),
$T=310$ K, $P_2/P_1=2$, there is obtained $ME_c=6.8$ Kw.

The efficiency of the LRC is given by e=6.8/13.2=0.515 or 51.5%.

When a rotating envelope of the same dimensions is considered and all other parameters are kept the same, it can be anticipated that the liquid velocity relative to the rotating envelope will be reduced by a factor of 3 or so. The dissipation T is reduced by a factor of $3^3=27$, i.e., it is anticipated that the frictional loss will be reduced to T=5.74/27=0.21 Kw. The power which will be required by the RLRC will be P*=13.2+0.21−5.74=7.67 Kw., and the expected efficiency of the RLRC is e*=MEc/P*=6.8/7.67=0.887, which is 88.7%.

Thus, it is anticipated that the rotating envelope will improve efficiency by 88.7−51.5=37%.

The RLRC can be combined with a turbine as an efficient heat pump. The turbine can be a conventional expander, a liquid ring turbine, or a RLRT of a type similar to the RLRC, however, with the gas being introduced in such a way that it expands and absorbs heat from the liquid ring instead of ejecting heat to the ring.

For air conditioning heat pumps it is preferred to use hygroscopic brine in the liquid ring. The brine absorbs water vapor inside the compressor, ejects heat and vapor to the atmosphere, is cooled and concentrated via a direct contact heat exchanger with the outside air. When ventilation is required to remove odors and gases, the air expelled from the enclosure will be used in the preferred embodiment to cool the liquid and increase the efficiency of the RLRC. The colder the compressed air, the more efficient the compressor.

In winter, the RLRC can eject heat into the enclosure, while the compressed air expands in the turbine, contributing power to move the compressor, the compressed warm air is ejected to the outside but not before it exchanges heat with the fresh air which is introduced to maintain adequate ventilation in the enclosure.

Figure 5:
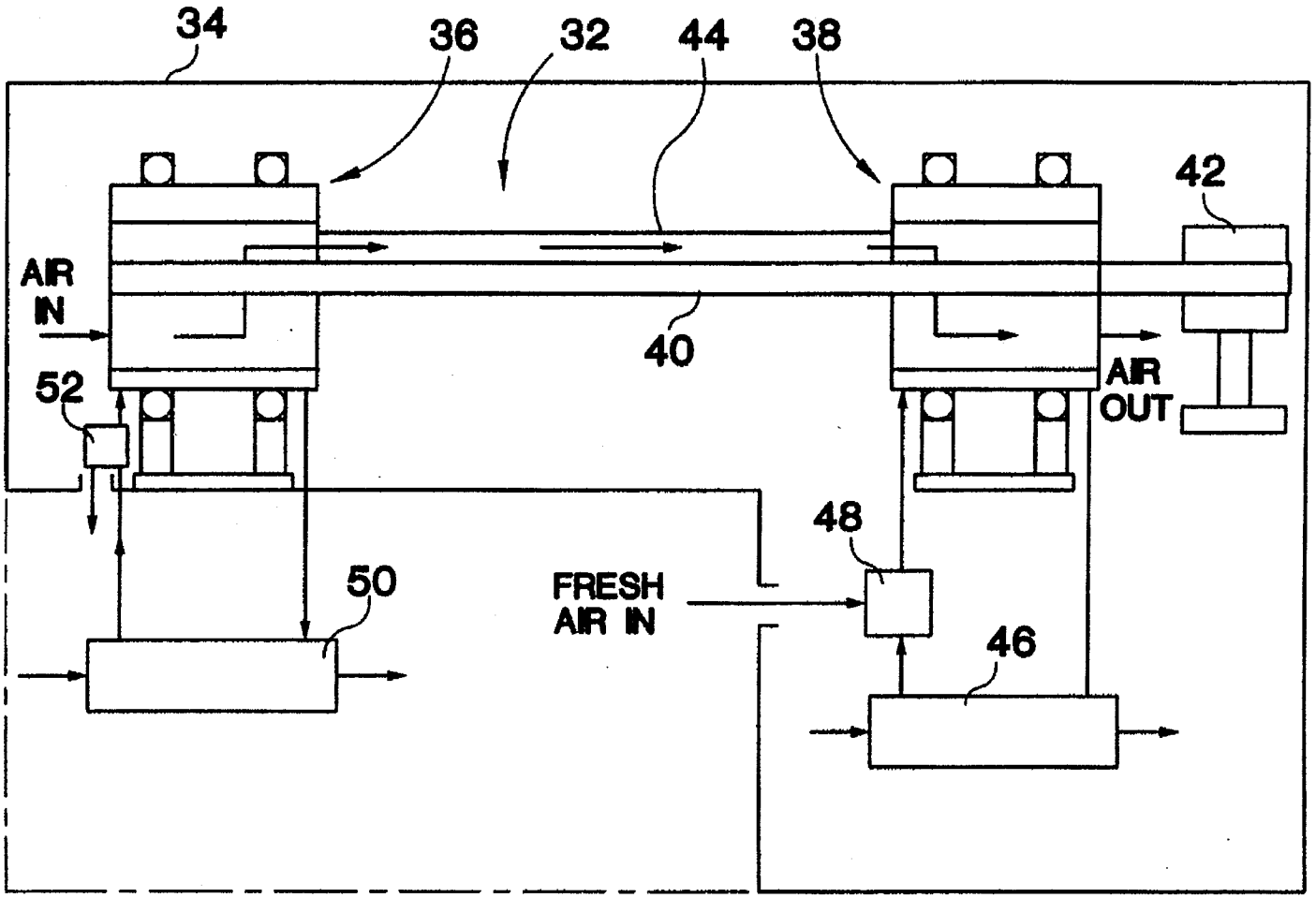
FIG. 5 is a schematic diagram of an air conditioning system incorporating a RLRC and a RLRT of the present invention.

Turning now to FIG. 5, there is illustrated an air conditioning system utilizing the RLRC of the present invention in combination with a LRT, advantageously, a RLRT.

The air conditioning system 32 is disposed inside an enclosure 34 to be conditioned, and comprises a RLRC 36, a RLRT 38 the rotors of both mounted on the same shaft 40 and operated by an engine 42. The RLRC 36 and the RLRT 38 are also interlinked by a duct 44 passing compressed air from the RLRC 36 to the RLRT 38. There is further seen an inside air-liquid heat exchanger 46 leading back to the RLRT 38 via an outside air-liquid heat exchanger 48. The RLRC 36 is interconnected with an outside air-liquid heat exchanger 50 leading back to the RLRC 36 via an inside air-liquid heat exchanger 52.

The operation of the air conditioning system including an RLRC 36 and a RLRT 38 is a follows: air is introduced into the brine liquid RLRC 36, and there is formed an exit pressure P of 3 bar and brine activity of 0.4, i.e., its vapor pressure is 40% of water at the same temperature. At p=3 bar the vapor pressure also increases 3 fold and therefore, vapor condenses on the brine even when the temperature of the brine is Tb=39° C.

The mechanical input energy (MEc) to the RLRC 36 is approximated as isothermal work at an average temperature T and is given by the equations:

$$T=306K\ [(25+41)/2+273]$$

$$ME_c=RTln(3)=96\ \text{Kj/Kg (for air } R=0.286\ \text{Kj/Kg.K)}$$

The air temperature is elevated from 25° C. to 41° C. and the internal energy of the air increases by 16 Kj/Kg. The vapor contents of the air reduces from 12 to 6.5 g/Kg, which amounts to 14 Kj/Kg, i.e., the energy which is disposed outside the enclosure is:

$$Q=96+14-16=94\ \text{Kj/Kg.}$$

Assuming that the RLRT 38 is isothermal at $T_f=24°$ C., the RLRT 38 can deliver mechanical work or power $$ME_f=-RT_fln(1/3)=93\ \text{Kj/Kg.}$$

The theoretical coefficient of performance (COP) of an ideal engine in the above cycle is given by:

$$COP=94/(96-93)\approx31.$$

As is known, heat dissipation in the RLRT and the RLRC reduces the efficiency of the compressor, as well as the turbine and, in addition, some energy is required to pump the liquid and to blow the air in the heat exchanger.

Thus, the actual performance can be approximated from the following equation:

$$COP=E_sQ/(ME_c/E_c-E_tME_t)$$

where, $E_s$ is the system efficiency, and $E_c$ and $E_t$, are the compressor and the turbine efficiencies, respectively.

In the following example it is assumed that $E_s$=0.85 and $E_c$=$E_t$=E, and hence, the results are given in the form of a Table:

| E | COP |
|---|---|
| 1 | 27. |
| 0.95 | 6.3 |
| 0.90 | 3.4 |
| 0.85 | 2.4 |
| 0.80 | 1.7 |

It is envisioned that the efficiency of an air conditioning system, according to the present invention, could be further increased by increasing the efficiency of either the compressor, the turbine, or both.

The system of FIG. 5 or a similar system can also be utilized for heating, by extracting the heat from the compressed air or gases and applying same to the fresh air in an enclosure.

Hence, utilizing a RLRC in a heating system while considering the above-described parameters, it can be shown that:

$ME_c$=95 Kj/Kg $ME_t$=87 Kj/Kg

Q=105 Kj/Kg (this includes the heating of the fresh air by the exhaust hot air).

The COP for heating includes also the engine work which eventually dissipates into heat. The performance of RLRC as heat pump for space heating, is given below:

| E | COP |
|---|---|
| 1. | 13 |
| 0.95 | 6.1 |
| 0.90 | 4.3 |
| 0.85 | 3.4 |
| 0.80 | 2.8 |

In addition to the use which can be made of a RLRC and a RLRT in the field of air conditioning, other usages are also envisioned, such as non-polluting gas turbines for motor vehicles and the like.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A rotating liquid ring compressor/turbine (RLRC/T), comprising:

a rotor having a core and a plurality of radially extending vanes mounted thereon;

a tubular jacket having outer and inner lateral portions, eccentrically, rotationally coupled with said rotor;

said jacket defining with said rotor a first zone, wherein edges of said vanes rotate in proximity to a first inner surface portion of said jacket and a second zone, wherein edges of said vanes rotate in spaced-apart relationship along a second inner surface portion of said jacket;

an inlet port communicating with said second zone, and an outlet port communicating with said first zone, wherein the eccentricity ecr of the jacket mounted on said rotor is given by:

$$ecr=(1-c)/3$$

where c is the ratio between the radius of the core C and the radius R of the jacket c=C/R.

2. The RLRC/T as claimed in claim 1, wherein said jacket and said core form a cylinder having an outer lateral side wall and an inner lateral side wall.

3. The RLRC/T as claimed in claim 2, further comprising a first sealing disc affixed to the inner surface of the outer lateral side wall of the jacket.

4. The RLRC/T as claimed in claim 2, further comprising a second sealing disc made integral with the core and extending adjacent to the inner surface of said inner lateral wall.

5. The RLRC/T as claimed in claim 1, wherein said core is mounted on a shaft extending outside said jacket from the inner lateral side.

6. The RLRC/T as claimed in claim 5, wherein said jacket is eccentrically, rotationally mounted on said shaft by means of bearings.

7. The RLRC/T as claimed in claim 5, wherein the shaft of said rotor is hollow.

8. The RLRC/T as claimed in claim 1, wherein at least the end portions of the rotor's vanes diverge by an angle which is less than 20° from the radial direction.

9. The RLRC/T as claimed in claim 1, wherein brine liquid is utilized to form said liquid ring.

10. The RLRC/T as claimed in claim 1, further comprising a cooling system for cooling the liquid inside said jacket.

11. The RLRC/T as claimed in claim 10, wherein said cooling system comprises a gas liquid separator leading to a heat exchanger, said separator communicating with the outlet port and said separator communicating with a hollow shaft of the rotor.

12. The RLRC/T is claimed in claim 1, further comprising heat exchange means for cooling the compressor and heating the turbine.

13. The RLRC/T as claimed in claim 1, wherein said compressor is an isothermal compressor and said turbine is an isothermal turbine.

14. The RLRC/T as claimed in claim 1, wherein said turbine is an adiabatic turbine.

15. The RLRC/T as claimed in claim 1, wherein said inlet and outlet ports are formed in said outer lateral side wall adjacent to the core.

16. The RLRC/T as claimed in claim 15, wherein said core is conical, sloping towards said inlet and outlet ports.

17. An air conditioning system, comprising:

a RLRC as claimed in claim 1;

a turbine in fluid communication with said RLRC;

an engine driving said RLRC and said turbine, and a first heat exchanger in fluid communication with said RLRC, and a second heat exchanger in fluid communication with said turbine.

18. The system as claimed in claim 17, wherein said turbine is a RLRT.

19. The system as claimed in claim 18, wherein said third heat exchanger is disposed inside said enclosure for expelling heat to the outside thereof.

20. The system as claimed in claim 18, wherein said fourth heat exchanger is disposed inside the enclosure and draws air from the outside thereof.

21. The system as claimed in claim 17, wherein a third heat exchanger is interconnected in fluid communication between said first heat exchanger and said RLRC.

22. The system as claimed in claim 17, wherein a fourth heat exchanger is interconnected in fluid communication between said turbine and said second heat exchanger.

23. The system as claimed in claim 17, wherein said RLRC, turbine and second heat exchangers are disposed within an enclosure to be conditioned.

24. A rotating liquid ring compressor/turbine (RLRC/T), comprising:

a rotor having a core and a plurality of radially extending vanes mounted thereon;

a tubular jacket having outer and inner lateral portions, eccentrically, rotationally coupled with said rotor;

said jacket defining with said rotor a first zone in which edges of said vanes rotate in proximity to a first inner surface portion of said jacket and a second zone in which edges of said vanes rotate in spaced-apart relationship along a second inner surface portion of said jacket;

an inlet port communicating with said second zone; and an outlet port communicating with said first zone;

wherein an eccentrically e of the jacket mounted on said rotor is given by:

$$e \geqq (1-c)/3$$

where c is the ratio between the radius of the core C and the radius R of the jacket, c=C/R.

* * * * *